United States Patent [19]

Sysak

[11] 4,391,903

[45] Jul. 5, 1983

[54] IONIC COPOLYMERS IN PHOTOGRAPHIC LIGHT-SENSITIVE SILVER HALIDE FILMS

[75] Inventor: Peter K. Sysak, Wilmington, Del.

[73] Assignee: E. I. Du Pont de Nemours & Co., Wilmington, Del.

[21] Appl. No.: 346,738

[22] Filed: Feb. 8, 1982

[51] Int. Cl.[3] ..... G03C 1/72

[52] U.S. Cl. ..... 430/629; 430/634; 430/636

[58] Field of Search ..... 430/629, 634, 636

[56] References Cited

U.S. PATENT DOCUMENTS

| | | | |
|---|---|---|---|
| 3,168,403 | 2/1965 | Himmelmann et al. | 430/629 |
| 3,561,967 | 2/1971 | Sakai et al. | 96/87 |
| 3,753,716 | 8/1973 | Ishihara et al. | 430/634 |
| 4,153,458 | 5/1979 | Iguchi et al. | 430/629 |
| 4,225,665 | 9/1980 | Schadt | 430/529 |

*Primary Examiner*—Jack P. Brammer

[57] ABSTRACT

Ionic copolymers of styrene sulfonic acid and maleic acid improve covering power when added to the gelatin binder employed in medical silver halide X-ray emulsions.

5 Claims, No Drawings

IONIC COPOLYMERS IN PHOTOGRAPHIC LIGHT-SENSITIVE SILVER HALIDE FILMS

BACKGROUND OF THE INVENTION (1) Field of the Invention

The present invention relates to a photographic light-sensitive film having an improved layer containing gelatin and an ionic copolymer.

(2) Description of the Prior Art

It is known to increase the covering power of gelatino-silver halide emulsions by the substitution of various polymeric materials for part of the gelatin binder. Jennings, U.S. Pat. No. 3,063,838 discloses that covering power of gelatino-silver halide emulsions can be increased by the addition of dextran. The use of dextran, however, tends to produce optical haze. C. G. Dostes et al, Fr. Pat. No. 1,501,821 discloses gelatin subjected to enzyme treatment or enzyme treatment followed by reaction with an acid anhydride can be substituted for up to 50 percent by weight of the total gelatin of a gelatino-silver halide layer to increase covering power. However, the increase in covering power is not comparable to that of emulsions containing dextran. It is also known to add modified hydrolyzed gelatin (MHG) (U.S. Pat. No. 3,778,278, B. Rakoczy) to gelatino-silver halide emulsions to increase covering power to a level at least equal to that of an emulsion containing dextran, without haze. However, the addition of MHG tends to soften the binder.

Using the ionic copolymers of the invention, covering power is increased without any deleterious effects on film hardening or sensitometry.

SUMMARY OF THE INVENTION

The present invention is directed to a photographic film comprising a silver halide emulsion layer superimposed on a support, characterized in that the protective colloid (binder) component of the silver halide emulsion layer consists essentially of a major amount, in parts by weight, of gelatin, and a minor amount, in parts by weight, of an ionic copolymer, preferably a poly(styrene sulfonic acid-co-maleic acid) salt of the formula:

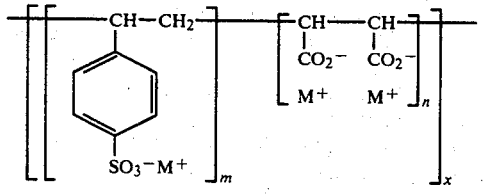

wherein M is an alkali metal, m=1-3, n=1, and x=5-50. Such copolymers are available commercially as aqueous solutions of their sodium salts, and their addition to a medical X-ray gelatino-silver halide emulsion provides improved covering power of developed silver. It is possible to replace 17-35% by weight of the gelatin in the silver halide emulsion layer with one of the ionic copolymers of this invention.

In this way, these copolymers reduce the need for silver in the photographic film more than current polymers, hence lower manufacturing costs. Medical X-ray film containing this polymer has good clarity after being developed, fixed, and washed.

The present invention may be applied to any type of silver halide emulsions, such as, a silver chloride emulsion, a silver bromide emulsion, a silver bromochloride emulsion, a silver iodobromide emulsion and a silver chloroiodo-bromide emulsion.

The silver halide emulsion to which the present invention is applied may be chemically sensitized in a known manner, such as by adding a compound containing unstable sulfur, such as sodium thiosulfate or by a gold compound, such as a complex salt of mono-valent gold and thiocyanic acid, or by a combination thereof. Moreover, the emulsion may be optically sensitized by adding a dye sensitizer, such as a cyanine dye or a merocyanine dye. Further, the emulsion may be stabilized by a heterocyclic compound, such as 4-hydroxy-6-methyl-1,3,3a-7-tetraazaindene. Still further, the emulsion may be hardened by a hardening agent, such as, formaldehyde glyoxal, mucochloric acid, chrome alum, or a triazine derivative.

The invention is illustrated by the Examples, wherein A and B are sodium salts of poly(styrene sulfonic acid-co-maleic acid) having the formula set forth below:

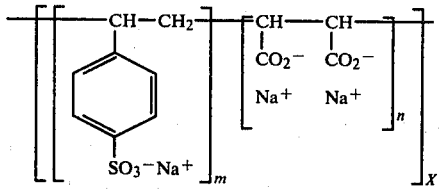

(A) m = n = 1; X ≈ 14
(B) m = 3, n = 1; X ≈ 5

EXAMPLE 1

A high speed negative gelatino-silver iodobromide emulsion having a silver halide: gelatin ratio of 1.8 was prepared using gold-sulfur sensitization as well known in the art. This emulsion was divided into seven parts and additives shown in the table below were added in amounts so that the final binder contained 83% gelatin and 17% additive. The emulsions were fed by positive displacement gear pumps to a two-slot coating bar where they were applied to poly(ethylene terephthalate) supports and simultaneously wet-overcoated with a protective gelatin overcoat containing chrome alum and formaldehyde as hardening agents. The two layer-coated samples were chilled and then dried to produce photographic films with 2.76 grams silver per square meter.

Film samples were sorted in black plastic bags at ambient temperature (70°-75° F.) (21°-24° C.). Silver covering power was measured 10 days and 21 days after coating. Films were exposed in a CRONEX ® (trademark of E. I. du Pont de Nemours and Company) sensitometer, and were machine developed to Dmax at 92° F. for 19-20 sec. in CRONEX ® XMD developer. The fixed and washed samples were dried at 135° F. (57.2° C.). Covering power was calculated as the ratio of maximum optical density (Dmax) to coating weight of developed silver (g/m$^2$). Optical density was measured on a MacBeth Quantalog ® Densitometer (trademark of MacBeth Instrument Corp., Newburg, N.Y.), silver coating weight was measured by X-ray fluorescence using a Panalyzer ®4000 (trademark of Panametrics, Inc., Waltham, Mass.). The gelatin melting point, recorded 10-12 days after the coatings were made, was measured as the temperature at which the film coating sloughed off the base in an aqueous 0.1 N NaOH solution.

Results are provided in Table 1 below:

TABLE 1

| Additive[1] | Amount in Grams | Covering Power ($m^2/g$) (10 days) | (21 days) | Gelatin Melting Point (°C.)[2] Over-coat | Emulsion |
|---|---|---|---|---|---|
| None | 82 | .48 | .49 | 49 | 60 |
| Gelatin | 82 | .52 | .55 | 48 | 59 |
| Dextran | 82 | .52 | .53 | 52 | 64 |
| Modified Hydrolyzed Gelatin (MHG) | 82 | .54 | .56 | 42 | 61 |
| Dextran/MHG[3] | 53/29 | .55 | .56 | 45 | 61 |
| A | 82 | .60 | .65 | 43 | 59 |
| B | 82 | .56 | .59 | 55 | 63 |

[1]10% aqueous solution of each additive

[2]Measured 10–12 days after coating

[3]Dextran is poly(D-glucose), patented as a covering power polymer in U.S. Pat. No. 3,063,838. MHG is patented as a covering power polymer in U.S. Pat. No. 3,778,278.

The results show the ionic copolymers of the invention increase covering power without any deleterious effects on film hardening. Other measurements show no deleterious effect of the ionic copolymers on film sensitometry.

EXAMPLE 2

Another batch of the high speed negative gelatino-silver iodobromide emulsion of Example 1 was prepared, and divided into 10 parts. Additives shown in Table 2 below were added in amounts so that the final binder contained the % additive indicated in the table plus gelatin. The pH of the emulsion was adjusted to 6.4–6.8 before coating. The emulsion was then skim-coated on a resin- and gelatin-subbed poly(ethylene terephthalate) support, and overcoated with an antiabrasion layer containing 1.5% gelatin, plus formaldehyde and chrome alum hardeners. The two-layer coated samples were then chilled and dried to produce photographic films having silver coating weight of 2.76 $g/m^2$. Covering power and the gelatin melting point were measured as described in Example 1. Results appear in Table 2 below:

TABLE 2

| Sample | % Additive | Gelatin melting pt.(°C.) | Dmax | Coating wt.(CW) $g/m^2$ | Covering power O.D. ÷ C.W. $m^2/g$ |
|---|---|---|---|---|---|
| 1 | Gelatin | 59 | 1.76 | 3.60 | .49 |
| 2 | 6% MHG + 11% Dextran | 58 | 2.31 | 4.0 | .58 |
| 3 | 12% MHG + 22% Dextran | 62 | 2.56 | 4.12 | .62 |
| 4 | None | 63 | 2.44 | 4.44 | .55 |
| 5 | 5% A | 55 | 1.98 | 3.8 | .52 |
| 6 | 15% A | 50 | 2.20 | 3.82 | .58 |
| 7 | 35% A | 52 | 2.35 | 3.84 | .61 |
| 8 | 5% B | 54 | 2.34 | 4.2 | .55 |
| 9 | 15% B | 55 | 2.67 | 4.48 | .60 |
| 10 | 35% B | 64 | 2.22 | 4.05 | .55 |

The results show films containing the ionic copolymers of the invention have higher covering power than the all-gelatin containing controls, and covering power comparable to films containing mixtures of prior art covering power polymers such as dextran and MHG.

I claim:

1. A photographic film comprising a silver halide emulsion layer superimposed on a support, characterized in that the binder component of the silver halide emulsion layer consists essentially of a major amount in parts by weight of gelatin and a minor amount in parts by weight of a poly(styrene sulfonic acid-co-maleic acid) salt of the formula:

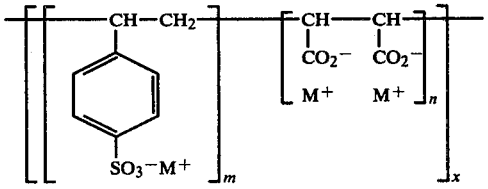

wherein M is an alkali metal, m=1–3, n=1, and x=5–50.

2. The photographic film of claim 1 wherein the silver halide emulsion layer is a medical X-ray emulsion.

3. The photographic film of claim 1 wherein 17–35% by weight of the gelatin in the silver halide emulsion layer has been replaced with the poly(styrene sulfonic acid-co-maleic acid) salt.

4. The photographic film of claim 1 wherein M=sodium and m=n=1.

5. The photographic film of claim 1 wherein M=sodium, m=3, and n=1.

* * * * *